US005198179A

United States Patent [19]

Bates

[11] Patent Number: 5,198,179

[45] Date of Patent: Mar. 30, 1993

[54] GAS INJECTOR

[75] Inventor: Kenneth W. Bates, Chesterfield, England

[73] Assignee: Injectall Limited, Sheffield, England

[21] Appl. No.: 623,437

[22] PCT Filed: Apr. 24, 1990

[86] PCT No.: PCT/GB90/00626

§ 371 Date: Dec. 14, 1990

§ 102(e) Date: Dec. 14, 1990

[87] PCT Pub. No.: WO90/12895

PCT Pub. Date: Nov. 1, 1990

[30] Foreign Application Priority Data

Apr. 24, 1989 [GB] United Kingdom ..... 8909290
Jul. 31, 1989 [GB] United Kingdom ..... 8917457

[51] Int. Cl.[5] ..... C21C 7/072

[52] U.S. Cl. ..... 266/217; 266/265; 266/270

[58] Field of Search ..... 266/217, 218, 220, 265, 266/270

[56] References Cited

U.S. PATENT DOCUMENTS

| | | | |
|---|---|---|---|
| 3,373,986 | 3/1968 | Spire | 266/39 |
| 3,971,548 | 7/1976 | Folgero et al. | 266/218 |
| 4,575,393 | 3/1986 | Bates et al. | 75/53 |
| 4,735,400 | 4/1988 | Tate et al. | 266/270 |
| 4,742,995 | 5/1988 | Bates | 266/270 |
| 4,789,141 | 12/1988 | Bates et al. | 266/270 |
| 4,802,655 | 2/1989 | Bates | 266/218 |
| 4,824,079 | 4/1989 | King | 266/44 |
| 4,840,356 | 6/1989 | Labate | 266/218 |
| 4,899,992 | 2/1990 | Thrower et al. | 266/220 |
| 4,944,496 | 7/1990 | Thrower et al. | 266/218 |

FOREIGN PATENT DOCUMENTS

| | | |
|---|---|---|
| 3115108 | 10/1982 | Fed. Rep. of Germany . |
| 3240097 | 5/1984 | Fed. Rep. of Germany . |
| 3523171 | 10/1986 | Fed. Rep. of Germany . |
| 8622452.2 | 5/1988 | Fed. Rep. of Germany . |
| 2451945 | 10/1980 | France . |
| 41-18201 | 10/1966 | Japan . |
| 59-38321 | 8/1982 | Japan . |
| 60-86202(A) | 5/1985 | Japan . |
| 1152330 | 5/1969 | United Kingdom . |
| 1452909 | 10/1976 | United Kingdom . |
| 1452910 | 10/1976 | United Kingdom . |
| 1594631 | 8/1981 | United Kingdom . |
| 2094954 | 9/1982 | United Kingdom . |
| 2150868 | 7/1985 | United Kingdom . |
| 2177485 | 1/1987 | United Kingdom . |
| 86/00695 | 1/1986 | World Int. Prop. O. . |

OTHER PUBLICATIONS

Radex-Runschau, Heft.3, 1983, B. Grabner et al., pp. 179-209.

*Primary Examiner*—Scott Kastler
*Attorney, Agent, or Firm*—Buchanan Ingersoll

[57] ABSTRACT

The invention provides a gas injector (50) for a molten metal vessel, comprising: a gas inlet chamber (51) having an inlet port and at least one outlet port (54), each said outlet port (54) having secured gas-tightly thereto an extruded rod (60) which extends to a gas discharge end (59) of the injector, the extruded rod (60) being formed of a substantially gas-impermeable e refractory material and having at least one axially-extending gas passage therealong, the passage communicating with the gas inlet chamber (51), and being of such small dimensions that in use, melt is substantially unable to intrude into the or each passage, the rod and compression gland connector being embedded in a refractory body of the injector save for the discharge end of the rod.

3 Claims, 3 Drawing Sheets

GAS INJECTOR

The present invention relates to an improved gas injector for introducing gases into elevated temperature liquids, more especially—but not exclusively—molten metals.

Gases are often injected into molten metals in vessels such as ladles, for diverse purposes. For instance, a gas may be introduced into the bottom part of a vessel to clear the relatively cool bottom area of solidification products, e.g. to remove them from the vicinity of a bottom pour outlet where the vessel has such an outlet. Again, gas may be introduced for "rinsing", or to homogenise the melt thermally or compositionally, or to assist in dispersing alloying additions throughout the melt. Usually an inert gas is used. Reactive gases may be employed, e.g. reducing or oxidising gases, when the melt composition or components thereof need modifying.

Previous gas injection proposals have included the installation of a solid porous refractory plug or brick in the refractory lining of the vessel. They can be simple, but not without various operational drawbacks. Unless very porous, when they would be unduly weak, they can limit the amount of gas reaching the melt significantly. If excessively high gas pressures are used, in order to compensate for the attenuating effect of the porous refractory, problems of sealing arise. Significant and often costly loss of gas results. Substantially all refractory materials are porous to gas, owing to the minute fissures disposed randomly throughout the refractory mass. The fissures or porosities provide meandering gas flow paths throughout the refractory body. Such haphazard flow paths are not especially helpful to the metal producer. Ideally, he would wish to apply gas pressure to an outer end of the refractory injector block and to have it issue only from the opposite, melt-confronting end of the block in a well-defined stream of gas. This does not ordinarily happen due to the wandering nature of the gas flow paths. In an effort to improve the performance of such solid injector bodies, workers in the art have resorted to directional-porosity techniques. In effect, they have tried making refractory injector bodies with a plurality of straight capillary-size passages extending from the inlet to the discharge ends of the bodies. Such passages have been created by casting or pressing refractory material in a mould about tensioned plastics or metal strands which are subsequently removed by burning or by pulling them from the refractory mass.

Whilst an injector body with directional porosity provided by capillary passages is better than an ordinary porous brick or plug, its efficiency is still less than ideal. When pressurised gas is applied to an inlet end of such a body, not all the gas flow is along the passages. Some of the gas finds its way into the porous refractory mass and thus is dissipated. Again, partly because the capillary passages are in practice less than perfect, gas can dissipate laterally from them into the surrounding refractory. The pressure of gas exiting the passages into the melt may be reduced to a level whereat the gas bubbles rather than jets into the melt. When the gas issues from a passage as a bubble, melt can instantaneously intrude into the passage and block it.

A further, and very significant problem, is how to join the refractory material of the injector body to the gas supply to provide a gas-tight seal. Known injectors have employed a metal jacket as indicated above wherein the jacket is gas-tightly secured (e.g. by threaded attachment) to the gas supply and the refractory body is cemented into the metal jacket. However, the cement between the refractory body and the metal constitutes a weakness. Although the metal jacket chamber may be distanced from the interior of the molten metal vessel by the refractory body, the jacket is nevertheless subjected to extreme elevated temperatures. Differential thermal expansion of the metal jacket, the cement and the refractory body can cause the jacket to break away from the refractory thereby breaking the gas-tight seal and causing the gas to be dissipated.

A further problem associated with such "canned" refractory plugs is that under the extreme conditions encountered in use, the metal jacket can crack thereby allowing gas to be dissipated into the adjacent refractory wall of the melt-containing vessel.

Dissipation of the gas in the manner described above will of course tend to reduce the flow of gas through the capillary passages in the plug thereby allowing ingress of melt and consequent blocking of the passages.

In order to attain an improved flow of gas through an injector plug, it is known to provide a gas passage through the plug by means of a length of metal tubing embedded in the refractory body of the plug. However, it is considered that such an arrangement would tend to suffer from several disadvantages.

Firstly, unless such metal tubes have a capillary bore, it is considered that a constant flow of gas through the tubes would be necessary in order to prevent blockage by the ingress of molten metal. The need to shut off the gas supply at the end of each injection operation would therefore result in blockage and would tend to make it difficult if not impossible to re-use the plug. Secondly, if very small bore metal tubes were used, it is considered that there would be substantial practical difficulties in providing a gas-tight seal between the inlet end of the metal tube and the gas supply inlet pipe.

Thus, there is a need for an injection plug which can be produced economically and simply and which provides a substantially leak-proof gas passage between the gas supply inlet pipe and the injection orifices in the discharge face of the injector plug. The present invention addresses this problem and it has been found that a substantially leak-proof system results from the use of a refractory rod formed of substantially material, gas flow through the rod being by way of narrow passages along its length, the rod being gas-tightly secured to a gas inlet chamber.

In a first aspect, therefore, the present invention provides a gas injector for a molten metal vessel, comprising: a gas inlet chamber in the form of a metal enclosure having an inlet port and at least one outlet port; and at least one extruded rod which extends to a gas discharge end of the injector, the or each extruded rod being formed of a substantially gas-impermeable refractory material and having at least one axially-extending gas passage therealong, the passage communicating with the gas inlet chamber, and being of such small dimensions that in use, melt is substantially unable to intrude into the or each passage; the or each extruded rod being secured gas-tightly to an outlet port of the gas inlet chamber and being embedded in a refractory body of the injector save for the discharge end of the rod.

In one embodiment the or each extruded rod is secured gas-tightly to an outlet port by means of a compression gland connector. The compression gland connector suitably contains a gland packing element which is formed of a compressible graphitic material, for example exfoliated graphite.

In another embodiment, the or each extruded rod is secured gas-tightly to an outlet port through being encased in a pipe with a gas-impermeable wall, which pipe is gas-tightly connected with the outlet port, for example by threaded attachment. The pipe may encase substantially the entire length of the extruded rod or only part of its length, for example up to 50% (e.g. up to 30%) of its length. Generally the extruded rod is cemented into the pipe.

Whilst it is possible for an injector to contain only one refractory rod, it is more usual for an injector to comprise an array of rods arranged, for example, in a particular configuration such as in a circle.

Whereas it is possible in principle for each such refractory rod to be connected to its own gas pipe, such an arrangement is highly impractical and would unnecessarily complicate the manufacture of the injectors thereby increasing the cost of the injectors. It is therefore preferable to employ a manifold arrangement wherein an inlet chamber is provided with a single inlet port for attachment to a gas supply pipe, but has a plurality of outlet ports.

The gas injector will generally be replaced at fairly regular intervals and thus may be regarded as a consumable item. As such, it is important to minimize the complexity of the injector in order to keep costs to an acceptable level. Thus a manifold arrangement of the type referred to hereinabove should be ideally of a simple construction requiring relatively few operations in its manufacture. A further requirement for such a manifold is that it should resist distortion by the combination of high pressure and temperature encountered in use.

Even though the manifold in use is shielded from direct contact with the molten metal by the refractory material, it is nevertheless subjected to very high temperatures and, at such temperatures, can become plastic and thereby more easily distorted by higher gas pressures.

The above problems can be overcome by employing as the inlet chamber or manifold a cast and/or welded metal enclosure comprising a back wall having an inlet port, a front wall having one or more outlet ports, and a side wall linking said front and back walls, said front and back walls being further linked by one or more support stays therebetween.

Preferably the support stay forms a gas-conduit having a closed end gas-tightly secured (e.g. welded) to the front wall, and an open end forming the inlet port, the side wall of the conduit having holes therein to permit gas flow between the inlet port and the or each outlet port.

The extruded refractory rod can be secured gas-tightly to the neck portion of the outlet port by means of a compression gland connector. The compression gland connector comprises a compressible gland packing, usually in the form of a ring through which the refractory rod can be inserted, and a threaded collar which is placed about the refractory rod. The threaded collar can be screwed into or onto the outlet port, by way of an adaptor if necessary, to compress the gland packing therebetween so as to cause it to be compressed against the refractory rod thereby providing a gas-tight seal.

It will be appreciated from the foregoing disclosure that the gland packing will need to be capable of withstanding extreme temperatures and hence advantageously it is formed from graphite. One form of flexible graphitic material particularly suitable for the purposes of the present invention is a form known as exfoliated graphite flake. Exfoliated graphite flake is commercially available under the trade name "Flexicarb" (TRADE MARK) from Flexicarb Graphite Products Ltd., of Heckmondwike, Yorkshire, England.

The refractory rods are formed of a gas impermeable material, for example they can be formed of mullite, a fired alumino-silicate, or recrystallized alumina. Such rods are available commercially for use as thermocouple sheaths.

Because the refractory is formed of a gas-impermeable material and is gas-tightly connected with the outlet port via the packing gland, and because pressurized gas is thereby delivered directly into the passages of the gas impermeable refractory rod, the gas cannot dissipate into the refractory injector body. Accordingly, an efficient transport of gas into the molten metal can be attained.

Preferably, the refractory rod comprises a plurality of passages in the form of capillary bores or slots. In either case, the passages are individually sufficiently small that intrusion of melt into them substantially cannot occur in practice. Typically the capillary bores or slots will have a diameter or width in the range from 0.2 mm to 0.6 mm.

Desirably, the refractory rods are disposed in a predetermined array optimised for efficient injection of gas into a melt. By way of example, the rods may be uniformly spaced about a longitudinal axis of the injector body, i.e. in a circular array or in a plurality of concentric circular arrays.

The injector according to the invention can be installed in a gas injection apparatus as disclosed and claimed in our International Patent Application No. W088/08041. It will then take the place of the plugs 312 shown in the drawings of W088/08041.

The invention comprehend a molten metal vessel, e.g. a ladle, having an insulating lining and an injector according to the invention melt-tightly secured in a receiving opening of the lining.

BRIEF DESCRIPTION OF THE DRAWINGS

The invention will now be described in more detail, by way of example only, with reference to the accompanying drawings, in which:

FIG. 1 of the drawings shows a prior art apparatus for injecting gaseous substances into e.g. molten metal. The apparatus, which is the subject of W088/08041, includes a nozzle block 310 for installing in the wall 10 of a vessel 12. The nozzle block 310 has a passage 311 closed by a plug at its gas discharge end, the plug 312 being pierced by capillary bores 313 and having a feed pipe 316 gas tightly coupled thereto. The feed pipe 316 extends along the passage 311 from the plug 312 and terminates in an inlet member 324 by which the pipe receives gas from an external gas duct system 315 which, in turn, is connected to a supply of gas under pressure.

Figure 1:
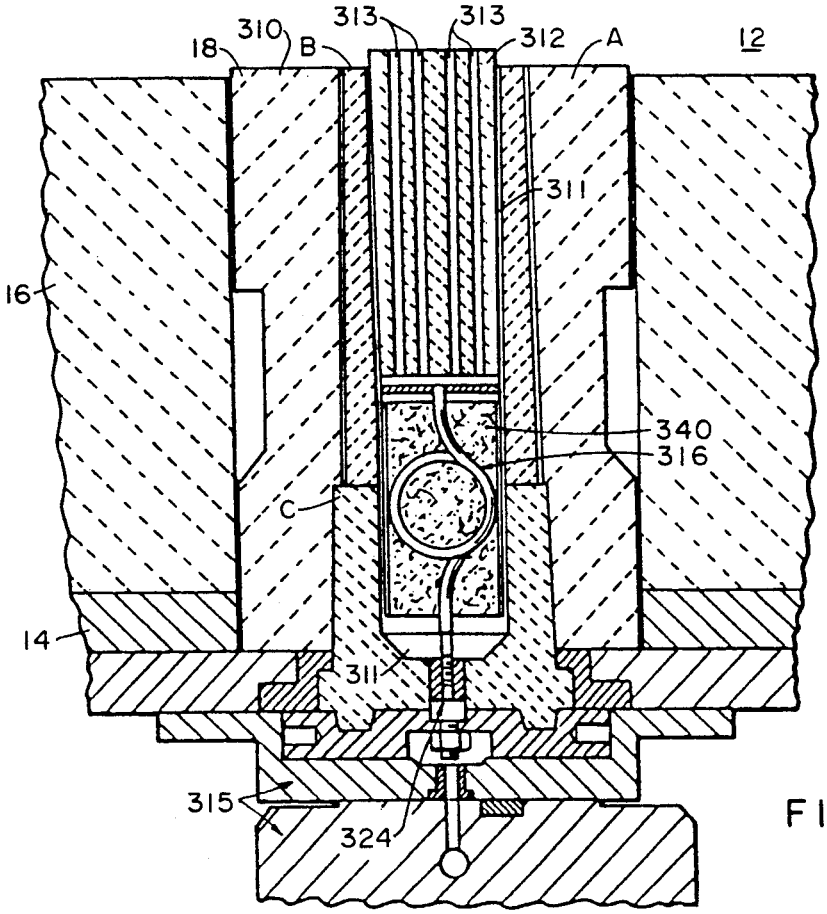
FIG. 1 shows a prior art gas injection apparatus installed in the bottom wall of a vessel such as a ladle.

As shown, the vessel 12 has a metal shell 14 and a refractory lining 16 having, in this case, a bottom opening 18 to accommodate the nozzle block 310. It will be apparent from FIG. 1 that the nozzle block 310 comprises an assembly of three refractory members A, B and C in this instance. However, if preferred, the block 310 can be a single monolithic member.

In accordance with the teaching of W088/08041, the feed pipe 316 can be surrounded by a cartridge element 340 which contains a particulate refractory filling.

For further details of the injection apparatus described briefly above, and alternative embodiments thereof, reference is directed to W088/08041.

The apparatus disclosed in W088/08041 has an injection plug 312 made of a refractory material pierced by a plurality of capillary bores 313. Moreover, gas under pressure is applied to the whole of the lower end face of the plug 312 by the feed pipe 316. This arrangement is practical, but less than ideal as we have indicated hereinbefore. The gas injector to be described hereinafter is primarily, but not exclusively, meant for use in apparatus of the kinds of similar to the injector apparatuses taught in W088/08041. In principle, for instance, the present gas injector can be substituted for any of the porous brick or plug arrangements hitherto employed in e.g. the bottom wall of a ladle.

Figure 3:
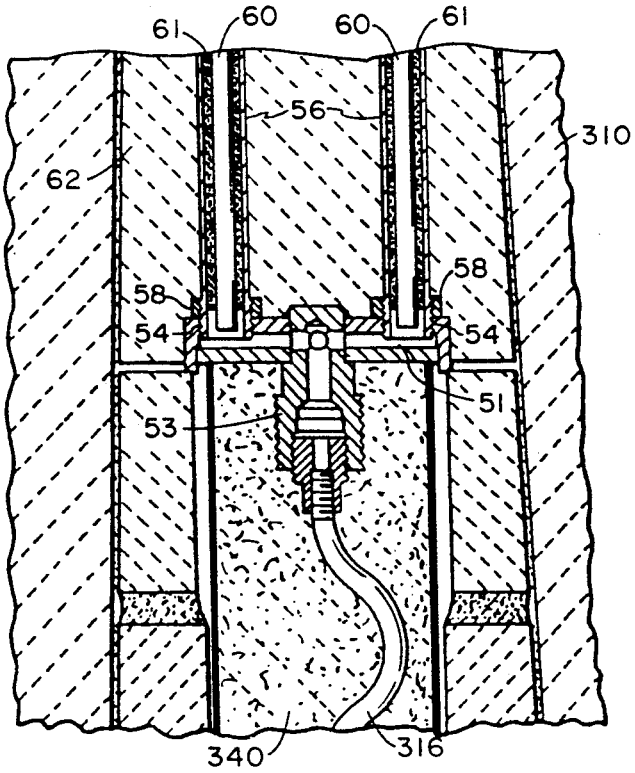
FIG. 3 is a fragmentary longitudinal sectional view of the apparatus of FIG. 2 on an enlarged scale.
Figure 2:
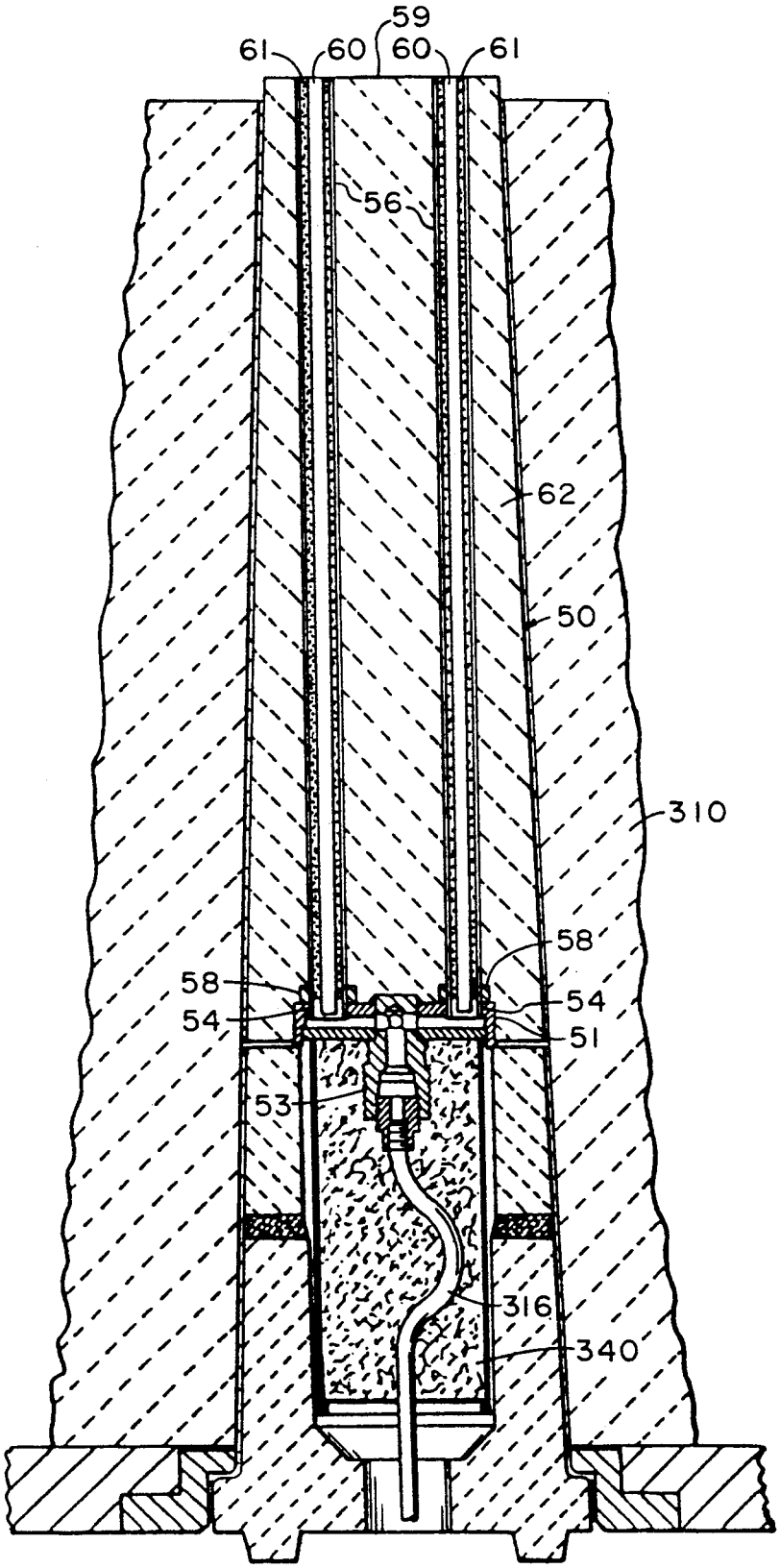
FIG. 2 is a longitudinal sectional view through an injection apparatus according to the invention.

FIGS. 2 and 3 show an improved gas injector according to the present invention.

The injector 50 comprises a gas-tight inlet chamber 51 having an inlet port to which an inlet fitting 53 is secured, the fitting 53 in use serving to couple the feed pipe 316 and the inlet chamber 51 gas-tightly one to the other. The inlet chamber is in this case an all-metal welded capsule with the inlet port in one face. The opposite face of the chamber 51 has a plurality of outlet ports 54.

Connected to each outlet port 54 is a gas delivery pipe with a gas-impermeable wall. The pipes 56 are connected to their outlet ports 54 by inter-engaging screw threads on the ends of the pipes and in the ports, aided by lock nuts 58. Sealant is applied to the threads before assembling the pipes 56 and inlet chamber 51, to achieve a gas-tight connection between each pipe 56 and the inlet chamber 51. The gas delivery pipes 56 extend to a gas-discharge end 59 of the injector 50.

Each of the pipes 56 encases an extruded refractory rod 60 which is cemented in situ in the pipe. The cement layer is indicated in FIG. 3 at 61. The rods terminate at the discharge ends of their pipes 56. As shown, the rods 60 extend the full length of the pipes 56 although, if preferred, they could terminate short of the ends of said pipes connected to the inlet chamber 51.

The extruded refractory rods 60 are preferably in a fired state. Each rod is extruded to include at least one, and preferably more than one, axially extending gas passage. The or each passage is of sufficiently large dimensions that it will convey gas freely to the melt in vessel 12, but is too small to permit the melt to intrude substantially into the passage.

As stated, each refractory rod 60 preferably has a plurality of gas passages. They can take the form of lengthwise-extending capillary bores, or narrow slots, or a combination of both. Suitable rods are commercially available as plural-passage thermocouple tubes.

Apart from their discharge ends, the pipes 56 are embedded in a refractory body 62 of the injector 50. The inlet chamber 51 is also partially embedded in the body 62.

As will be appreciated, gas fed to the injector 50 via inlet chamber 51 can only exit from the injector 50 through the discharge ends of the pipes 56. Accordingly, there is no call to use the body 62 per se for transporting gas to the melt, thus solving many of the problems mentioned hereinbefore. The body 62 therefore does not have to be made of high grade refractory materials, and moreover it does not need to be enclosed by a metal jacket. A cementitious castable material can conveniently and cost-effectively be employed for the body 62, which is thus readily castable about the inlet chamber 51 and pipes 56. Such a castable could comprise "CP26" from the Hinckley Group of Companies, Sheffield, England.

Conceivably, the injector 50 could comprise but a single gas delivery pipe 56, but preferably it has several, e.g. 5 or 10 identical pipes 56. The pipes 56 are arranged according to some pre-determined array selected for ease of manufacture of the injector, balanced with the desire to optimise efficient distribution of gas into the melt. By way of example, the pipes 56 are disposed equidistant from a longitudinal axis of the injector, equally spaced from one another in a circular array. Depending on the number of pipes 56, they could be disposed around a plurality of concentric circles about the longitudinal axis.

The extruded refractory rods 60 can have any convenient number of gas passages. By way of example, they can each feature say ten passages disposed in a circular array about the longitudinal axis of the respective rod.

As shown in the drawings, the inlet chamber is a welded (or brazed) fabrication for example of mild steel. Conceivably, the chamber could be a lost-core casting.

Ordinarily, as stated above, the injector body 62 is not encased in a metal jacket. It will be installed in the nozzle block 310 using a relatively weak cement. The injector body 62 complete with its pipes 56 and inlet chamber 51 can then be extracted from the nozzle block 310 when it has to be replaced. Conveniently, the injector 50 is extracted by a threaded puller which is connected to the inlet fitting after disengaging the feed pipe 316 therefrom.

Figure 4:
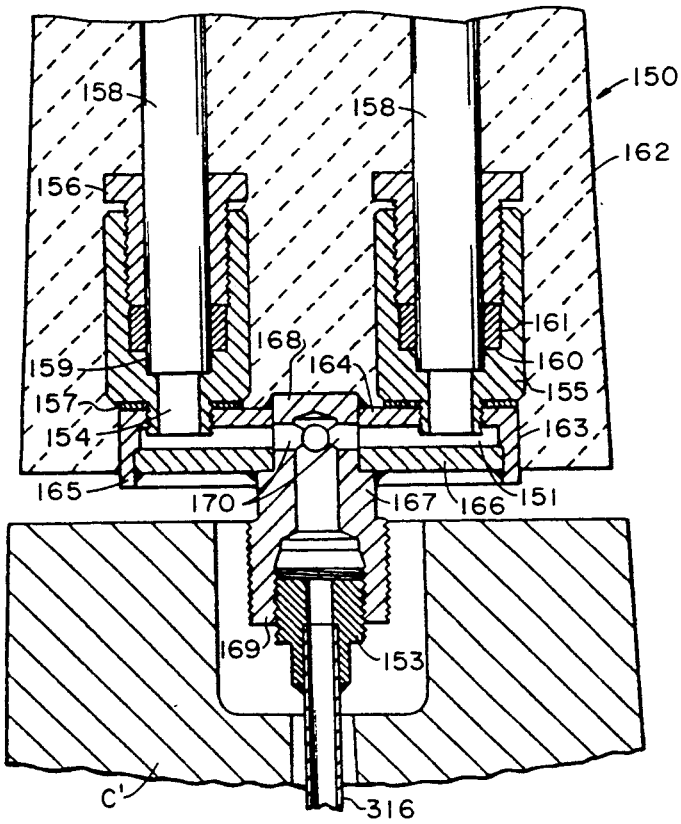
FIG. 4 is a fragmentary longitudinal sectional view through another injection apparatus incorporating a gas injector according to the present invention.

FIG. 4 illustrates a second type of gas injector according to the present invention. The injector 150 comprises a gas-tight inlet chamber 151 of the type described above in relation to the gas-injector of FIGS. 2 and 3. Thus, the chamber has an inlet port to which an inlet fitting 153 is secured, the inlet fitting 153 serving to couple the feed pipe 316 and the inlet chamber 151 gas-tightly one to the other. The chamber 151 has a plurality of outlet ports 154.

Connected to each outlet port 154 by means of inter-engaging screw threads is an open-ended generally cylindrical tubular member 155 formed of mild steel, referred to hereinafter as an adaptor, which has a screw thread on its inner surface for engaging a corresponding thread on the outer surface of a collar 156. The collar can also be made from mild steel. The join between the outlet port 154 and the adaptor 155 is gas-tightly sealed by means of an annealed copper washer 157. Received within the collar 156 is an extruded refractory rod 158 of the type described hereinabove, the end of which abuts against a stepped region 159 of the inner surface of the adaptor 155. A further stepped region 160 on the inner surface of the adaptor accommodates a gland packing ring 161, formed of compressible exfoliated graphite, which encircles the refractory rod 158. During manufacture of the injector, the threaded collar 156 is screwed tightly into the adaptor 155 thereby to compress the gland packing ring 161 such that it forms a gas-tight seal against the refractory rod 158.

Apart from their discharge ends, which are not shown in FIG. 4, the refractory rods are embedded in a refractory body of the injector. The inlet chamber 151 and gland seal connector 155, 156, 161 are also partially embedded in the body 162 which, as stated above in the description of the embodiments shown in FIGS. 2 and 3, can be formed from a cementitious castable material. The castable material can advantageously contain metal fibres, for example steel fibres (e.g. stainless steel) as a means of strengthening the body. The body 162 can be fired or unfired, but advantageously it may be fired to increase its resistance to thermal shock. As an alternative to being cast and then fired, the body may be formed by pressing and then firing.

Conceivably, the injector could comprise but a single gas delivery rod, but preferably it has several, e.g. 5 or 10 identical rods. The rods are arranged according to some predetermined array selected for ease of manufacture of the injector, balanced with the desire to optimise efficient distribution of gas into the melt. By way of example, the rods are disposed equidistant from a longitudinal axis of the injector, equally spaced from one another in a circular array. Depending on the number of rods, they could be disposed around a plurality of concentric circles about the longitudinal axis.

The inlet chamber 151 is formed of a first mild steel casting 163 which provides a front wall 164 and a side wall 165. Welded into a peripheral recess in the side wall is a circle of mild steel plate 166 which constitutes the back wall of the inlet chamber. A generally cylindrical hollow member 167, formed of mild steel, extends through the back 166 and front 164 walls, a closed end 168 of the cylindrical member being welded to the front wall 164 and a middle portion of the cylindrical member being welded to the back wall 166 to provide a gas tight seal. The outer and inner surfaces of that portion 169 of the cylindrical member extending outwardly from the back wall 166 are threaded, the inner threaded surface enabling attachment of the gas feed pipe 316. The cylindrical member is provided with holes 170 to enable gas flow through from the open end of the member, which serves as the inlet port, to the outlet ports 154.

In addition to functioning as a gas conduit, the cylindrical member, through being welded to both front and back plates, functions as a support or stay to prevent distortion of the inlet chamber under high pressures and at high temperatures.

Ordinarily, as stated above, the injector body is not encased in a metal jacket. It will be installed in the nozzle block 310 using a relatively weak cement. The injector body 162 complete with its refractory rods and inlet chamber 151 can then be extracted from the nozzle block 310 when it has to be replaced. Conveniently, the injector 150 is extracted by a threaded puller which is connected to the outer threaded surface of the cylindrical member 167 after disengaging the feed pipe therefrom.

The injectors 50 and 150 have been particularly devised for use in the kinds of injection apparatus disclosed in WO88/08041, but they are of wider application. They could, for instance, simply be mounted in an orificed block let into the refractory lining of a vessel. The inlet fitting 53/153 could then simply project from the shell of the vessel, for connection directly to a gas supply line.

In a specific example, there are five refractory rods each centered upon a circle of 65 mm diameter, and extending the length of the refractory body 62/162. The body is 41 cm long and tapers from a diameter, at its inlet chamber end, of 14.2 cm to 11 cm at its discharge end. The refractory rods have diameters of 16 mm and each contains a circular array of ten gas passage bores, each being 0.6 mm diameter.

Figure 5:
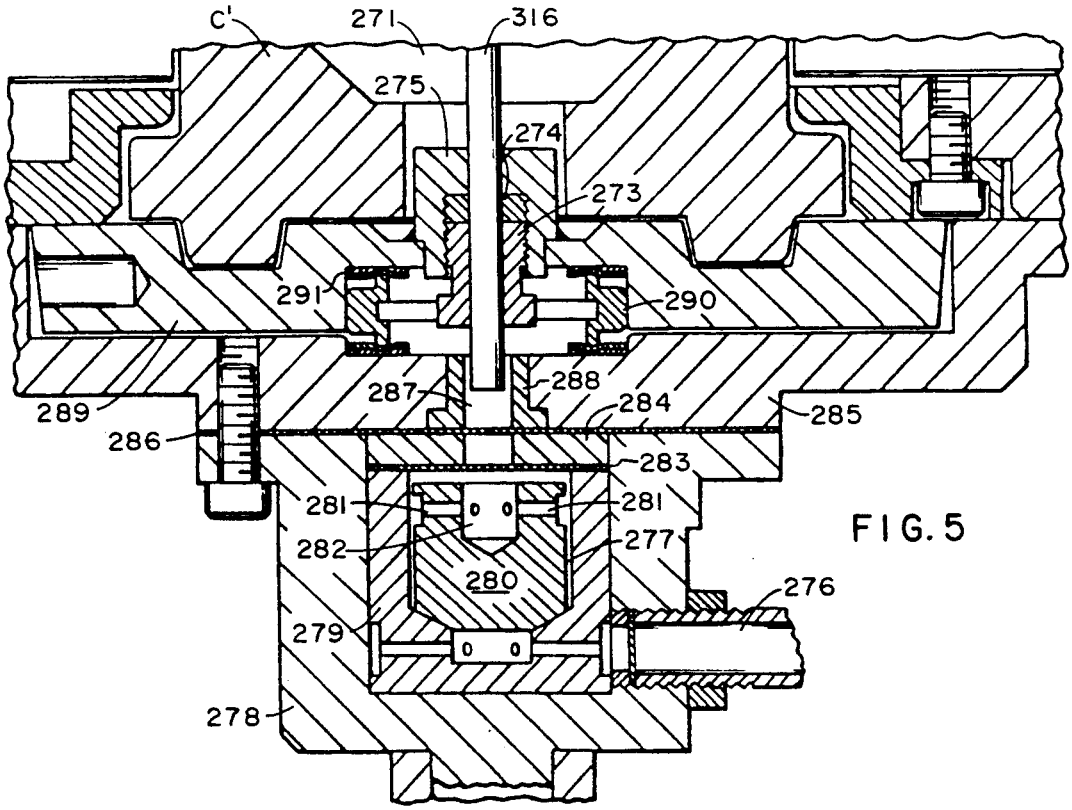
FIG. 5 is a longitudinal sectional view of a gas supply system which can be used in conjunction with the injectors of the present invention.

The outer refractory member C of the nozzle block 312 illustrated in FIG. 1 has a central void to accommodate the "pig-tail" loop in the feed pipe 316 and the cartridge element 340. The purpose of the loop in the feed pipe 316 is to absorb any movement of the nozzle block relative to the inlet member 324 of the gas supply thereby preventing or minimising any stress on the joints in the gas supply system so as to ensure that the system remains leak-proof. As indicated above, the injector of the present invention can be used in conjunction with a nozzle block arrangement and gas supply system as shown in FIG. 1. However, the injector can also be employed in combination with the gas supply system illustrated in FIG. 5. In this case, a modified nozzle block is used. The outer refractory member C is replaced by a member C' which has a much smaller central void and the "pig-tail" loop and cartridge 340 are eliminated. In FIG. 5 the feed pipe 316 extends through an orifice 271 in the outer portion C' of the nozzle block, the end of the feed pipe 316 passing through a gland seal 273, 274, 275 containing an exfoliated graphite gland packing ring 274. The purpose of the gland seal 273, 274, 275 is to maintain a gas-tight seal about the end of the feed pipe 316 whilst accommodating any movement of the nozzle block injector and feed pipe which may occur as a result of thermal expansion during use. This arrangement replaces the "pig-tail" loop arrangement illustrated in FIG. 1. The gas supply system includes a pipe 276 and one-way valve assembly to which gas from a source (not shown) is fed. The valve assembly has a valve chamber 277, a valve cover 278 and a valve liner 279. Located inside the valve chamber is a copper "float" 280 which has gas passages 281 and 282. In use, gas passes into the valve chamber 277 forcing the copper float 280 towards the outlet filter 283 which is held in place between the valve liner 279 and a valve top plate 284. The gas flows through the gas passages 281 and 282 and out, via the filter 283 through an aperture in the valve top plate 284. When the gas supply is turned off, the float falls back against the bottom wall of the valve chamber.

The valve cover is held against a retaining plate with a valve cover gasket 286 compressed therebetween to form a gas-tight seal. Lining an aperture 287 in the retaining plate 285 is an insert 288 formed of copper. The end of the feed pipe 316 extends into the aperture 287.

Sandwiched between the retaining plate 285 and the outer portion C' of the injector nozzle block is a steel plate 289 to which is welded the body of the gland seal 273, 274, 275.

When dismantling the injector apparatus, for example in order to replace the injector plug, the one-way valve assembly, retaining plate 285 and steel plate 289 are each removed. When replacing them, it is necessary to ensure a gas-tight seal. In practice, due in part to differential thermal expansion in use, it is very difficult to secure a gas-tight seal between plates 289 and 285 by means of a flat seal gasket. Therefore a seal ring arrangement is employed which comprises a seal ring 290 manufactured for example from mild steel (steel grade EN3) and a seal ring gasket 291 formed for example of asbestos yarn embodying stainless steel reinforced wire with a maximum service temperature of 815° C.

The gas supply system illustrated in FIG. 5 provides a leak-free supply of gas to the injector illustrated in FIG. 4. A further advantage of the gas supply system illustrated arises from the use of the copper components 280, 284 and 288. Whereas an advantage of the injectors of this invention is their improved durability, it is just conceivable that the refractory rods and surrounding refractory body might break up under the effect of excessive ladle lining wear. This should be a rare event, but if it happened it could result in molten metal entering the gas feed pipe. If such a situation were to arise, the copper components 280, 284 and 288 will rapidly conduct heat away from the molten metal causing it to freeze thereby sealing the system against leakages of molten metal to the surroundings.

The gas supply apparatus illustrated in FIG. 5 is intended in particular for use in a ladle apparatus.

INDUSTRIAL APPLICABILITY

The invention is applicable to the introduction of gases into elevated temperature liquids such as molten metals contained in vessels such as ladles. By means of the invention, gas losses hitherto experienced in gas injection are minimized and effective gas injection into a liquid is achieved. The gas injected can be employed to stir the liquid, to homogenize it thermally or compositionally, to assist dispersal of alloying additions or to modify the composition of the liquid by chemical reaction between the liquid and the gas.

We claim:

1. A gas injector for a molten vessel, comprising a gas inlet chamber in the form of a metal enclosure having an inlet port and at least one outlet port; and an extruded rod which extends to a gas discharge end of the injector, the extruded rod being formed of a substantially gas-impermeable refractory material and comprising a plurality of passages in the form of capillary bores or narrow slots, the passages communicating with the gas inlet chamber, and being of such small dimensions that in use, melt is substantially unable to intrude into the passages; the extruded rod being secured gas-tightly to the outlet port of the gas inlet chamber and being embedded in a refractory body of the injector save for the discharge end of the rod.

2. A gas injector for a molten metal vessel, comprising a gas inlet chamber having an inlet port and an outlet port, said outlet port having secured gas-tightly thereto by means of a compression gland connector, an extruded rod which extends to a gas discharge end of the injector, the extruded rod being formed of a substantially gas-impermeable refractory material and comprising a plurality of passages in the form of capillary bores or narrow slots communicating with the gas inlet chamber, and being of such small dimensions that in use, melt is substantially unable to intrude into the passages, the rod and compression gland connector being embedded in a refractory body of the injector save for the discharge end of the rod.

3. A gas injector for a molten metal vessel, comprising a gas inlet chamber having an inlet port, an outlet port and a pipe with a gas-impermeable wall gas-tightly connected with the latter and extending to a gas-discharge end of the injector, the pipe encasing an extruded refractory rod terminating at a discharge end of the pipe and comprising a plurality of passages in the form of capillary bores or narrow slots of such small dimensions that, in use, melt is substantially unable to intrude into the passages, the pipe being embedded in a refractory body of the injector save for its discharge end.

* * * * *

UNITED STATES PATENT AND TRADEMARK OFFICE

CERTIFICATE OF CORRECTION

PATENT NO. : 5,198,179

DATED : March 30, 1993

INVENTOR(S) : KENNETH W. BATES, NICOLAS WOOLLEY

It is certified that error appears in the above-indentified patent and that said Letters Patent is hereby corrected as shown below:

On the title page, under item [19], after "Bates" insert --et al.--.

Item [75], insert --Nicolas Woolley--.

Signed and Sealed this

Fifteenth Day of February, 1994

*Attest:*

*Attesting Officer*

BRUCE LEHMAN

*Commissioner of Patents and Trademarks*